US006428269B1

(12) United States Patent
Boratgis et al.

(10) Patent No.: US 6,428,269 B1
(45) Date of Patent: Aug. 6, 2002

(54) TURBINE ENGINE BEARING SUPPORT

(75) Inventors: Ernest Boratgis, Springfield, MA (US); James B. Coffin, Manchester, CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 09/837,504

(22) Filed: Apr. 18, 2001

(51) Int. Cl.[7] ..... F01D 21/00

(52) U.S. Cl. ..... 415/9; 415/229; 415/174.4; 411/2

(58) Field of Search ..... 415/9, 229, 216.1, 415/174.4, 244 A; 411/5, 3, 2

(56) References Cited

U.S. PATENT DOCUMENTS 4,289,360 A 9/1981 Zirin
5,974,782 A * 11/1999 Gerez ..... 415/9

FOREIGN PATENT DOCUMENTS

EP 0814236 12/1997

* cited by examiner

*Primary Examiner*—F. Daniel Lopez
*Assistant Examiner*—Kimya N McCoy
(74) *Attorney, Agent, or Firm*—Bachman & LaPointe, P.C.

(57) ABSTRACT

A bearing support for a rotor of an aircraft turbine engine includes a frangible linkage designed to enable the engine to safely shut down despite the introduction of an excessive unbalance to the fan stage.

9 Claims, 2 Drawing Sheets

TURBINE ENGINE BEARING SUPPORT

BACKGROUND OF THE INVENTION

The present invention relates to a method and a device which allows an aircraft turbine engine to safely shut down despite the introduction of a large rotor unbalance due to, for example, excessive damage to a fan blade.

An unbalance in the rotor of an aircraft turbine engine during operation creates a rotational load which is transmitted to the turbine engine structure through bearings and bearing supports, causes rotor-to-stator contact, and is then transmitted to the aircraft's structure. There are two types of unbalance: inherent manufacturing unbalance and accidental unbalance. Inherent manufacturing unbalance are at low levels, although they are not negligible. Accidental unbalance comes mainly from excessive blade damage. This unbalance can be considerable and can result in a rotational load which can be excessive. The engine must be capable of safely shutting down before it damages the aircraft structure. Consequently, a first problem to solve is to maintain the turbine engine in operation, despite the unbalance, at least for a limited time until the engine can be safely shut down without damaging the engine support structure.

Modern turbine engines generally contain a first stage of rotating blades called the fan stage which provides the fundamental propulsion effort, particularly in subsonic turbine engines. These fan blades are very vulnerable to foreign object damage, since they are located at the very front of the turbine engine, because they are thin, of large size and held at one end by the rotor while the other end is free at the rotor's periphery. Although the damage usually occurs near the free end of the blade, the unbalance it generates can be excessive because of the large size and high rotational speed of the blade. The unbalance in large turbine engines can produce a rotational load on the order of >200,000 LBS at 6,000 RPM. Therefore, in the presence of such a great unbalance a second problem is to keep the aircraft structure intact.

U.S. Pat. No. 4,289,360 discloses a turbine engine containing a normally rigid bearing support, but which can be released by the breakage of linkage elements under the effect of a strong unbalance. The unbalance can be a result of excessive damage to a rotor blade rotating in a housing with a thick abradable material. The rotor then tends to rotate around its new axis of inertia, which reduces the unbalance and the load that is exerted on the turbine engine support and aircraft structure.

EP 0 814 236 discloses a rigid bearing support system for a rotor of a turbine engine bearing and a frangible connection for reducing load on the engine's support structure at excessive rotor unbalance. One disadvantage of the system resides in the fact that the frangible connection is subjected to predominately shear load which is undesirable because of the tight dimensional control required between each bolt and bolt hole to insure a repeatable load distribution among the bolts Accordingly, it is the principle object of the present invention to provide a bearing support system for an aircraft turbine engine, which allows the engine to safely shut down after excessive unbalance is introduced at the fan stage.

It is a further object of the present invention to provide a bearing support system, as set forth above, which includes a frangible link, which fractures in response to excessive unbalance of the rotor.

It is a still further object of the present invention to provide a frangible link, which is subjected to predominantly tensile force, where shear forces are substantially eliminated.

Further objects and advantages of the present invention will appear hereinbelow.

SUMMARY OF THE INVENTION

The present invention relates to a method and a device which allows an aircraft turbine engine to safely shut down despite the introduction of rotor unbalance due to, for example, excessive damage to a fan blade of the fan stage of an aircraft turbine engine.

An aircraft turbine engine comprises a rotor having a shaft which rotates about an axis of rotation R during balanced engine operation, a fan stage having at least two fan blades attached to the shaft, a bearing support structure for supporting the shaft for rotation, said bearing support structure comprising a front bearing and a rear bearing, and a first bearing support and a second bearing support for securely attaching the front bearing and the rear bearing to the aircraft turbine engine's support structure, respectively. In accordance with the present invention, the first bearing support includes a joint located at an axial distance "a" from the front bearing. The joint includes a frangible linkage which is designed to substantially eliminate shear forces on the frangible linkage so that the frangible linkage is subjected to predominantly tensile force.

The present invention further relates to a method for sensing predetermined excessive operating unbalance of the rotor and thereafter decreasing load transfer to the aircraft turbine engine's support structure, which includes substantially eliminating the transfer of shear forces to the frangible linkage and breaking the frangible linkage at a tensile force corresponding to the predetermined excessive operating unbalance of the rotor such that the support of the rotor by the front bearing is lost and the shaft rotational action is changed to decrease load transfer to the engine's support structure.

The present invention provides an improved bearing support system which allows a turbine engine to shut down in a safe manner after experiencing an unacceptable operating unbalance of the rotor.

DETAILED DESCRIPTION

The present invention will be described with reference to well known gas turbine engines per se. Such turbine engines are well known in the art and, accordingly, only those components of the turbine engine which are necessary to properly understand the invention will be described.

Figure 1:
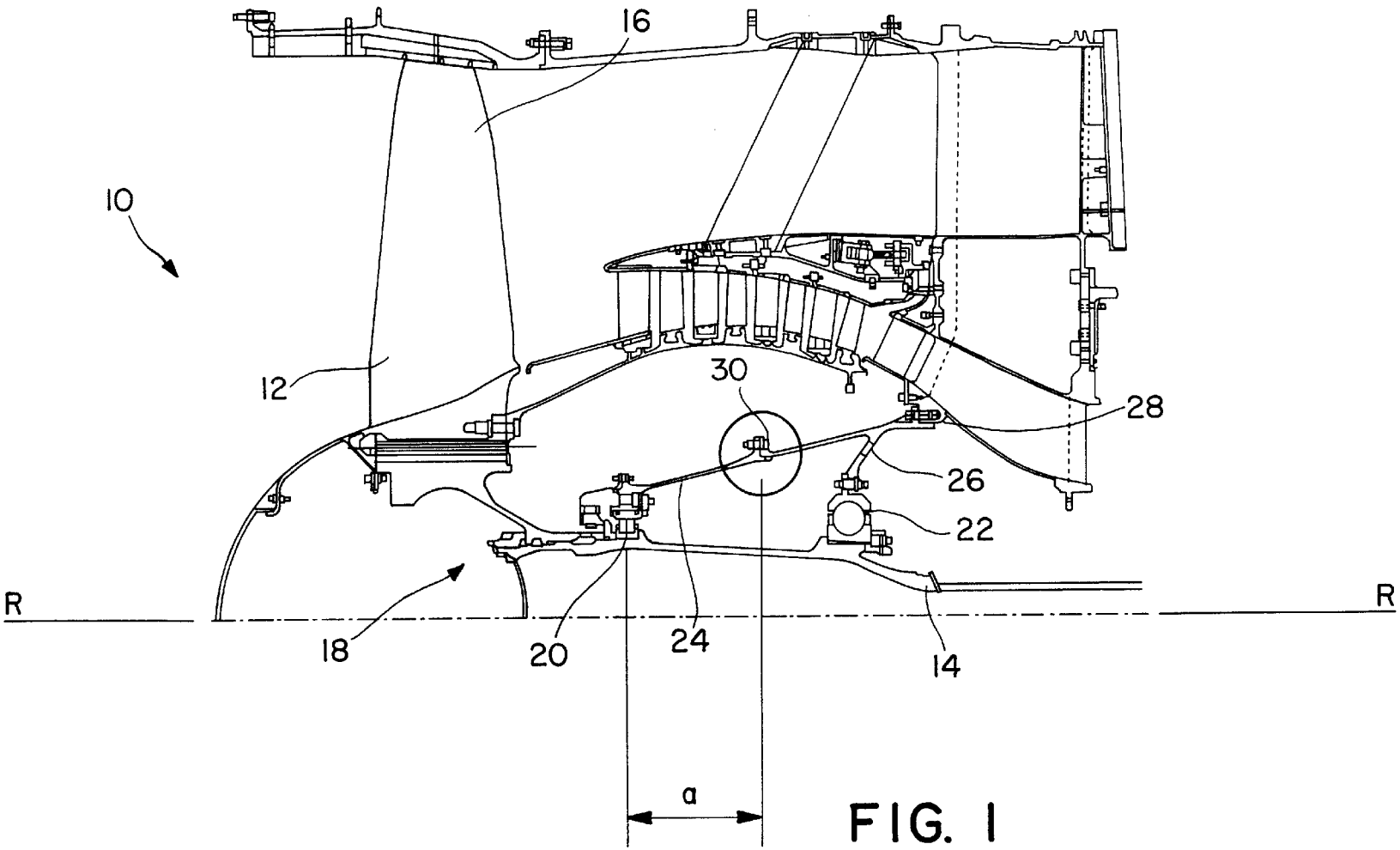
FIG. 1 is a partial sectional illustration of a gas turbine engine fan stage incorporating the frangible coupling in accordance with the present invention.

With reference to FIG. 1, a fan stage of an aircraft turbine engine 10 includes a fan stage 12 having a fan rotor shaft 14 which rotates around a geometric axis of rotation R. The fan stage 12 includes a plurality of fan blades 16 regularly distributed around the periphery of the rotor shaft 14.

The rotor shaft 14 is guided during normal rotation of the shaft around the geometric axis R on a bearing support system 18 which includes a front bearing 20 and a rear bearing 22, a first bearing support 24 and a second bearing support 26 for securely attaching the front and rear bearings 20, 22 to the engine support structure 28.

In accordance with the present invention, the bearing support includes a joint 30 which is located at an axial distance "a" from the front bearing 20 between the front bearing 20 and the rear bearing 22. The distance "a" is selected to insure a known moment is generated at the joint 30 as a result of a shear load acting at the front bearing 20. The shear load at the front bearing results from the introduction of an unbalance load at the fan stage 12.

In accordance with the present invention, it is preferred that the front bearing is comprised of a roller bearing while the rear bearing be a ball bearing. A roller bearing is preferred for the front bearing 20 as it substantially eliminates the transfer of a variable moment from the rotor through the bearing 20 to the joint 30 which includes a frangible linkage 32 (see FIG. 2). The introduction of excessive unbalance at the fan stage 12 will cause the shaft 14 to slope at the front bearing 20 location, due to moment loading. Restricting this slope, which occurs when a ball bearing is mounted on the shaft 14 at the front position, would cause a variable moment to be transferred through the bearing and first bearing support to the joint 30. The transferred moment would vary as a function of engine operating condition. The elimination of this variable moment to the joint 30 greatly improves the repeatability of the frangible link performance, regardless of engine operating condition. By using a roller bearing at the front position, the shaft sloping will not be restrained. Therefore, no shaft induced moment will be transferred to the joint 30, With reference to FIG. 2, the joint 30 includes a frangible linkage 32 which is designed to fracture at a load, created by excessive operating unbalance of the rotor, which does not challenge the engine support structure. The load which causes breakage of the frangible linkage should be high enough to not interfere with normal operating unbalances which occur during operation of the aircraft turbine engine. In addition, it is important that the design of the joint be such that the fracture of the frangible link is accomplished in a repeatable manner at the design load so as to insure that there is no catastrophic failure which would affect safe flying of the aircraft.

Figure 2:
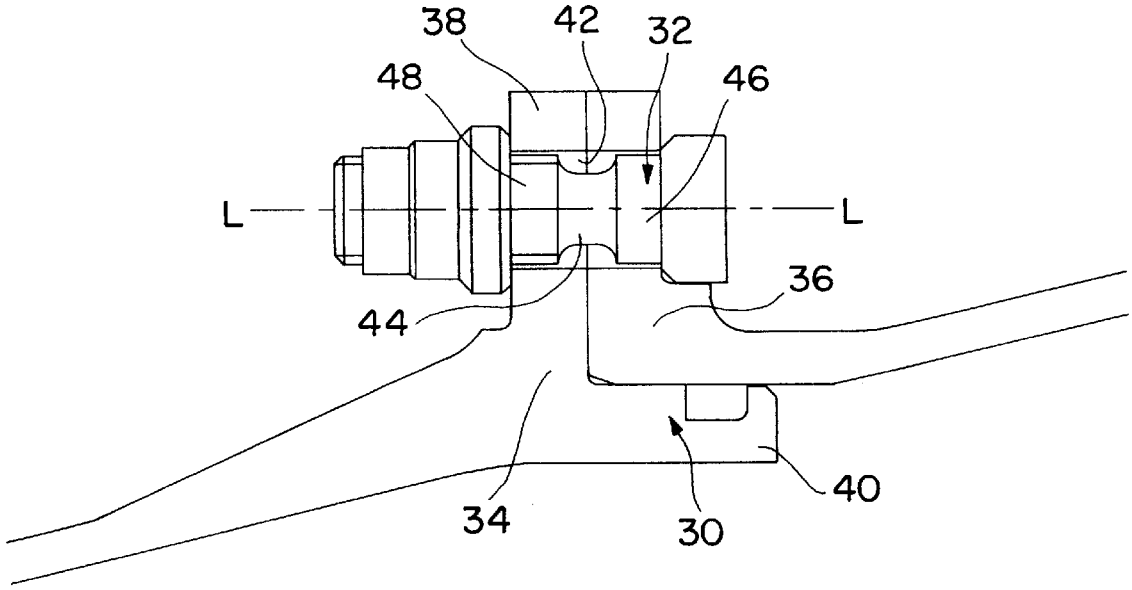
FIG. 2 is an enlarged view of the frangible link in accordance with the present invention.

The design of the joint 30 and the frangible linkage 32 will be discussed in detail with reference to FIG. 2. Initially it should be noted that, as is known in the art, the first and second bearing supports, the front bearing and the rear bearing extend circumferentially about the shaft. Accordingly, the joint 30 likewise extends circumferentially about the shaft. The joint will be described with reference to the cross-sectional blow-up shown in FIG. 2. However, in light of the fact that the joint extends circumferentially around the shaft, it should be noted that the joint includes a plurality of frangible links 32, the size and number of which are designed to allow for breakage at the desired load as described above. The load at which breakage of the frangible linkage occurs is a function of the number of frangible links 32, the shape and size of the frangible links 32, the distance "a" that the joint 30 is from the front roller bearing 20, the radial distance "b" that the links 32 are from the geometric axis of rotation R, and a flange geometric prying factor. With reference to FIG. 2, the joint 30 is formed by first and second circumferential members 34 and 36. Member 34 is, in cross-section, a substantially L-shaped member having an upstanding portion 38 and a base portion 40. As noted above, member 34 extends circumferentially around rotor shaft 14 and thus, the base portion 40 thereof forms a continuous extending flange circumferentially around the rotor 14. The joint further includes a second upstanding member 36, the lower portion of which rests on the base portion 40 of the first member 34. The upstanding member 36 abuts the upstanding portion 38 of member 34 and members 36 and 38 are provided with, around the circumference thereof, a plurality of inline holes 42 along axis L which is substantially parallel to the axis of rotation R of the rotor 14. The inline holes receive the frangible links 32 which, in a preferred embodiment, comprises a bolt having a reduced diameter central portion 44 between two larger diameter portions 46 and 48. The reduced diameter portion 44 is sized to insure breakage of the frangible linkage 32 at the reduced portion 44. As noted above, the number of frangible links (bolts) and the size of same are designed to insure breakage of the linkage at the desired design load.

Base portion 40 of the first L-shaped member 34 extends along an axis substantially parallel to both axis R and axis L. The base portion 40 substantially eliminates the transfer of shear to the frangible linkage 32. As a result, the frangible linkage 32 is exposed to substantially only tensile forces. As a result, tolerance requirements between the inline holes 42 and the frangible 32 linkage are not as critical as when the linkage is designed to break in shear. A shear type linkage would only be loaded once contact occurred between the perimeter of the inline holes 42 and the links 32. The load transferred to each link 32 is highly dependent upon the initial distance between the perimeter of each inline hole 42 and the link 32. Therefore, tight tolerance controls would be required to insure that the load transferred to the linkage would be distributed in a predictable manner among the links. In addition, tight controls would be required on the true position of the inline holes 42 to insure that they are truly inline. Thus, there is considerable savings in production and increase in repeatability with the present invention.

It is to be understood that the invention is not limited to the illustrations described and shown herein, which are deemed to be merely illustrative of the best modes of carrying out the invention, and which are susceptible to modification of form, size, arrangement of parts and details of operation. The invention rather is intended to encompass all such modifications which are within its spirit and scope as defined by the claims.

What is claimed is:

1. In an aircraft turbine engine comprising a rotor having a shaft which rotates about an axis of rotation R during balanced engine operation, a fan stage having at least two fan blades attached to the shaft, a bearing support structure for supporting the shaft for rotation, said bearing support structure comprising a front bearing and a rear bearing, and a first bearing support and a second bearing support for securely attaching the front bearing and the rear bearing to the aircraft turbine engines support structure, respectively, the improvement comprising the first bearing support includes a joint located at an axial distance "a" from the front bearing, the joint includes a frangible linkage wherein the joint is designed so as to substantially eliminate shear forces on the frangible linkage so that the frangible linkage is subjected to tensile force.

2. An aircraft turbine engine according to claim 1 wherein the joint includes a flange portion extending substantially parallel to the axis of rotation R for substantially eliminating shear force on the frangible coupling.

3. An aircraft turbine engine according to claim 1 wherein the joint comprises a first substantially L-shaped member having an upstanding portion and a base portion and a second upstanding member which rests on the base portion and abuts the upstanding portion, the upstanding portion and upstanding member having in line holes along an axis L which receives a bolt which forms the frangible linkage.

4. An aircraft turbine engine according to claim 3 wherein the axis L is substantially parallel to the axis of rotation R.

5. An aircraft turbine engine according to claim 3 wherein the base portion is substantially parallel to the axis L.

6. An aircraft turbine engine according to claim 3 wherein the bolt comprises a reduced diameter central portion between two larger diameter portions for forming the frangible link.

7. An aircraft turbine engine according to claim 1 wherein the front bearing is a roller bearing which substantially eliminates transfer of a variable moment from the rotor through the bearing and to the frangible linkage.

8. An aircraft turbine engine according to claim 6 wherein the first and second bearing supports, the front bearing, the rear bearing and the joint extend circumferentially about the shaft and the frangible linkage comprises a plurality of bolts.

9. In an aircraft turbine engine comprising a rotor having a shaft which rotates about an axis of rotation R during balanced engine operation, a fan stage having at least two fan blades attached to the shaft, a bearing support structure for supporting the shaft for rotation, said bearing support structure comprising a front bearing and a rear bearing, and a first bearing support and a second bearing support for securely attaching the front bearing and the rear bearing to the aircraft turbine engines support structure, respectively, a method for sensing predetermined excessive operating unbalance of the rotor and thereafter decrease load transfer to the aircraft turbine engine's support structure comprising the steps of:

providing a device including a frangible linkage in the first bearing support at a distance "a" from the front bearing; substantially eliminating the transfer of shear force to the frangible linkage while subjecting the linkage to tensile force; and breaking the frangible linkage at a tensile force corresponding to the predetermined excessive operating unbalance of the rotor whereby support of the rotor by the front bearing is lost and the shaft rotational axis is changed so as to decrease load transfer to the engine's support structure.

* * * * *